United States Patent [19]

Dennhardt

[11] 4,394,085

[45] Jul. 19, 1983

[54] PROCESSING STATION FOR CHARGING, EXPOSING AND DEVELOPING PRINTING MASTERS

[75] Inventor: Werner Dennhardt, Bad Kreuznach, Fed. Rep. of Germany

[73] Assignee: Hoechst Aktiengesellschaft, Frankfurt am Main, Fed. Rep. of Germany

[21] Appl. No.: 326,482

[22] Filed: Dec. 2, 1981

[30] Foreign Application Priority Data

Dec. 15, 1980 [DE] Fed. Rep. of Germany ..... 3047205

[51] Int. Cl.[3] ..... G03G 15/00; G03G 15/28

[52] U.S. Cl. ..... 355/3 R; 355/8; 355/14 R; 355/14 SH

[58] Field of Search ..... 355/3 R, 14 R, 8; 271/94, 245

[56] References Cited

U.S. PATENT DOCUMENTS 4,010,882 3/1977 Turner ..... 355/3 SH X
4,099,810 7/1978 Stange ..... 355/3 SH X
4,149,798 6/1978 McGowen et al. ..... 355/8
4,232,960 11/1980 Glab ..... 355/8
4,232,964 11/1980 Nodov et al. ..... 355/8 X

FOREIGN PATENT DOCUMENTS 2462216 7/1977 Fed. Rep. of Germany .

*Primary Examiner*—A. C. Prescott
*Attorney, Agent, or Firm*—Schwartz, Jeffery, Schwaab, Mack, Blumenthal & Koch

[57] ABSTRACT

A processing station for charging, exposing and developing printing plates comprising an exposure table, two corona devices, a developing unit and an optical scanning exposure device; said exposure table being adapted to be rotated through 180° about a pin and comprising two superposed tables which are arranged in such a way that their suction plates form the topside and the underside of the exposure table; said two corona devices being arranged symmetrically with respect to a developer roll, on a carriage underneath the exposure table; the said carriage being horizontally displaceable forward and backward with the aid of a drive means.

12 Claims, 2 Drawing Figures

PROCESSING STATION FOR CHARGING, EXPOSING AND DEVELOPING PRINTING MASTERS

BACKGROUND OF THE INVENTION

The present invention relates to a processing station for charging, exposing and developing printing masters, comprising an exposure table, at least one corona device, a developing unit and an optical scanning-exposure device.

The production of lettered and imaged printing plates in a processing unit is carried out in such a manner that the printing plates are first electrostatically charged and then an original is projected imagewise upon the plate. After this exposing procedure, the printing plate is developed with a developer, fixed and decoated. It is then ready for use on a printing press.

German Pat. No. 2,462,216 discloses an apparatus for the manufacture of printing plates by electrophotographic means, in which an individual printing plate is picked up from a stack in a plate holder by a transport device comprising a transport carriage with reduced pressure suction means. The transport carriage transfers the printing plate to an exposure platform. Charging of the individual printing plate and transporting it to the exposure platform are combined in a time-saving manner by mounting at the front of the transport carriage a corona charging station for the electrostatic charging of the printing plates. The corona charging station extends transversely to the direction of movement of the carriage which runs on two guide rails and is driven by a motor mounted on top. The carriage has a vacuum plate which is attached to its underside and which is, by a number of holes, connected with a vacuum pump. When the transport carriage is placed on top of the uppermost printing plate in the plate holder, reduced pressure is generated by which the printing plate is drawn by suction to the vacuum plate. By means of the motor, the transport carriage is then displaced in the direction of the exposure platform. As soon as the carriage has reached its position above the exposure platform, it is lowered, and the vacuum in the vacuum plate is released so that the printing plate is set free and is deposited on the exposure platform. The exposure platform is also designed as a vacuum plate and is subjected to reduced pressure, and as a result the printing plate is firmly held against the platform. After depositing the printing plate on the exposure platform, the transport carriage returns to its initial position above the plate holder.

U.S. Pat. No. 4,149,798 discloses a transport station for printing plates, which includes a stacking area containing a supply of printing plates. Printing plates are transported from the stacking area to a conveyor by means of a control mechanism which is provided with a number of suction cups. The conveyor transfers the printing plates to an exposure platform which has a plurality of holes on its upper surface and forms a chamber connected to a vacuum pump by a vacuum line. When the printing plate has assumed a predetermined position on the surface of the exposure platform, a vacuum is drawn, and the printing plate is held on the platform for exposure by means of an exposing system. The exposing system comprises a movable carriage as well as a corona charging device and a light-reflecting mirror mounted on the carriage. A laser which radiates modulated laser light is positioned in such a way that the emitted light beam is deflected by the mirror and impinges on the printing plate lying on the exposure platform, in a plane which is approximately normal to the plate surface.

In the prior art devices, the individual processing stages of a printing plate, such as charging, exposing and developing, proceed in chronological order in separate processing stations. A fresh printing plate can usually only be fed in, when the preceding plate has reached the fixing station or is leaving the fixing station. An additional delay is caused by the fact that a printing plate positioned on the exposure platform is only exposed during the forward travel of an optical scanning and recording device equipped with lasers and an appurtenant laser optical system, whereas processing does not take place while the scanning device travels backwards. That is to say that before another processing cycle for a printing plate can be started, the scanning device must return to its initial position.

SUMMARY OF THE INVENTION

It is the object of the present invention to provide an improved processing station for charging, exposing and developing printing masters.

A further object of the present invention is to provide an apparatus wherein charging, exposure and development are all effected at a single processing station.

Another object of the present invention is to provide a processing station which is capable of charging, exposing and developing printing masters in a shorter time.

It is also an object of the present invention to provide a processing station for charging, exposing and developing printing masters which has an increased productive capacity for a given unit of time.

Yet another object of the invention is to provide an apparatus for charging, exposing and developing printing masters wherein development can be effected substantially immediately after exposure.

Additionally, it is an object of the present invention to provide a processing station for charging, exposing and developing printing masters wherein excess developer is prevented from being carried away on the printing masters.

A still further object of the present invention is to provide a processing station for charging, exposing and developing printing masters which eliminates delays arising from the need to return the mechanism to the starting position before further processing can be effected.

It is another object of the present invention to provide a processing station for printing masters comprising a rotatable exposure table with two working sides.

An additional object of the invention is to provide a processing station for charging, exposing and developing printing masters which is adapted to process one printing master during forward movement of its mechanism and another printing master during backward movement of its mechanism.

These and other objects of the invention are achieved by providing a processing station for charging, exposing and developing printing masters comprising an exposure table, at least one corona device, a developing unit and an optical scanning exposure device; said exposure table being adapted to be rotated through 180° about a pin and comprising two superposed suction tables which are arranged in such a way that their suction plates form the topside and the underside of the exposure table.

In a preferred embodiment of the invention, the developing unit comprises a developer roll which is, together with two corona devices, arranged below the exposure table on a carriage which is capable of being horizontally moved forward and backward by a drive means. In this arrangement, the developer roll applies developer overhead to a printing plate which is retained by the suction plate on the underside of the exposure table. The two corona devices may be arranged symmetrically with respect to the developer roll.

In a further preferred embodiment of the invention, a scanning table carries a scanning device with a roof mirror arrangement comprising dichroic mirrors which are selectively transparent to a reading beam and a recording beam of different wavelengths, which are united in a common beam. The scanning table can be displaced synchronously with the developing unit and the corona devices. During the forward travel, the scanning table may be displaced in such a way that the roof mirror arrangement guides the recording beam between the developer roll and the rear corona device in the direction of forward travel and onto the printing plate to be exposed. During the backward travel of the scanning table, on the other hand, the recording beam guided by the roof mirror arrangement passes between the developer roll and the front corona device in the direction of forward travel and impinges upon the printing plate to be exposed.

Each of the two suction tables may advantageously be equipped with an internal, endlessly revolving drive means which can be raised to thereby lift a printing plate lying on the suction table from the upper surface of the exposure table for transfer to another processing station. The drive means may be constructed as chain drives and, after releasing the reduced pressure in the upper suction table, the corresponding chain drive is moved upwards out of the suction table.

The apparatus of the invention has the advantages that because the exposure table is made up of two suction tables and because two corona charging devices are used, it is possible to produce one printing plate during the forward travel and another during the backward travel of the scanning device. As a result, the output of processed printing plates is substantially increased. Similarly, the combination of the charging, exposing and developing stages has the effect of shortening the processing time. Additionally, development immediately after exposure gives printing plates with high-quality images which are rich in contrast. Overhead development by means of the developer roll prevents excess developer from being carried out of the processing station on the printing plate. Instead, any excess developer falls from the printing plate into a developer storage container.

BRIEF DESCRIPTION OF THE DRAWINGS

The invention will be explained in further detail with reference to the accompanying drawings wherein.

DETAILED DESCRIPTION OF A PREFERRED EMBODIMENT

Figure 1:
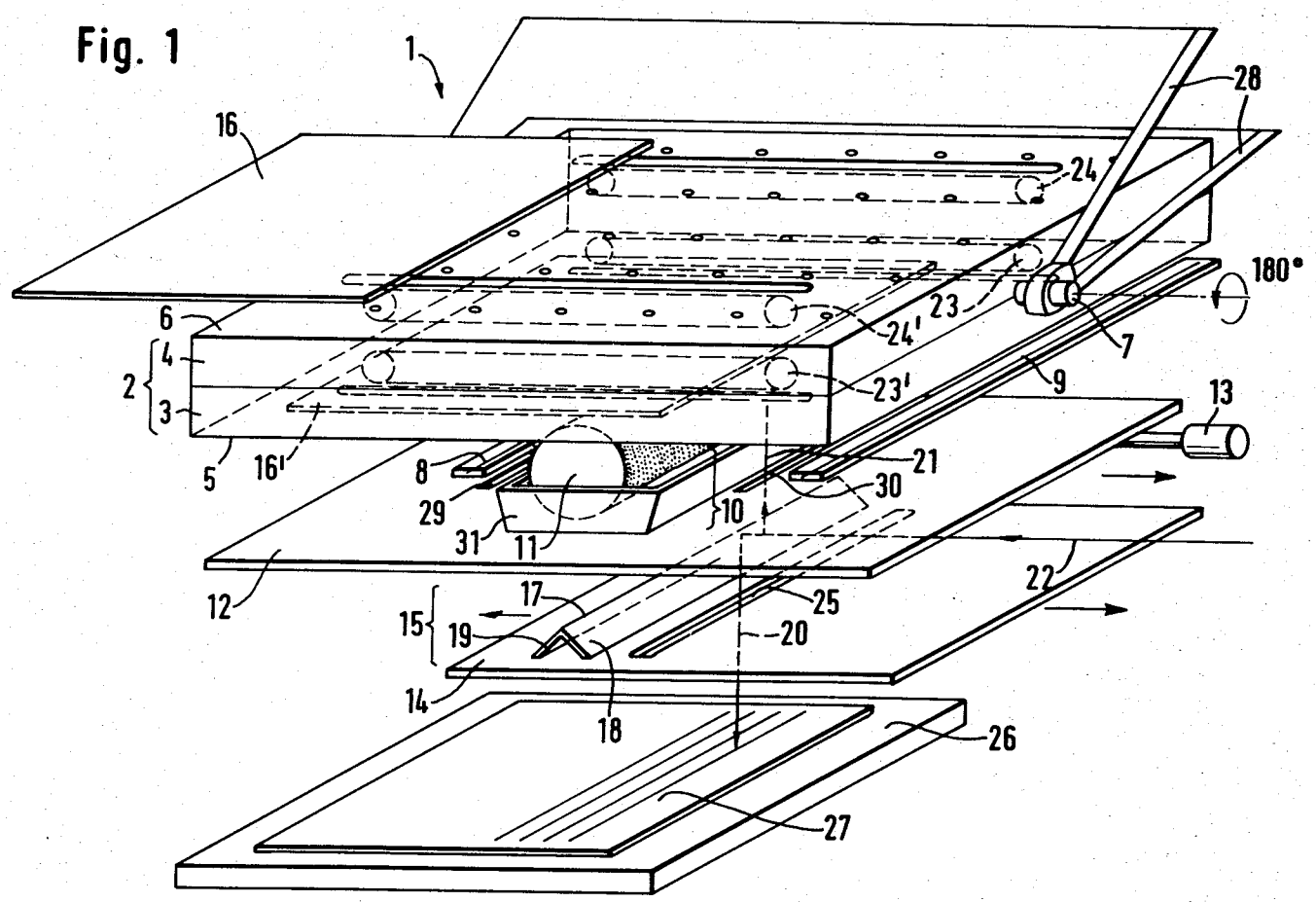
FIG. 1 is a diagrammatic representation of the processing station, during backward travel of the scanning table.
Figure 2:
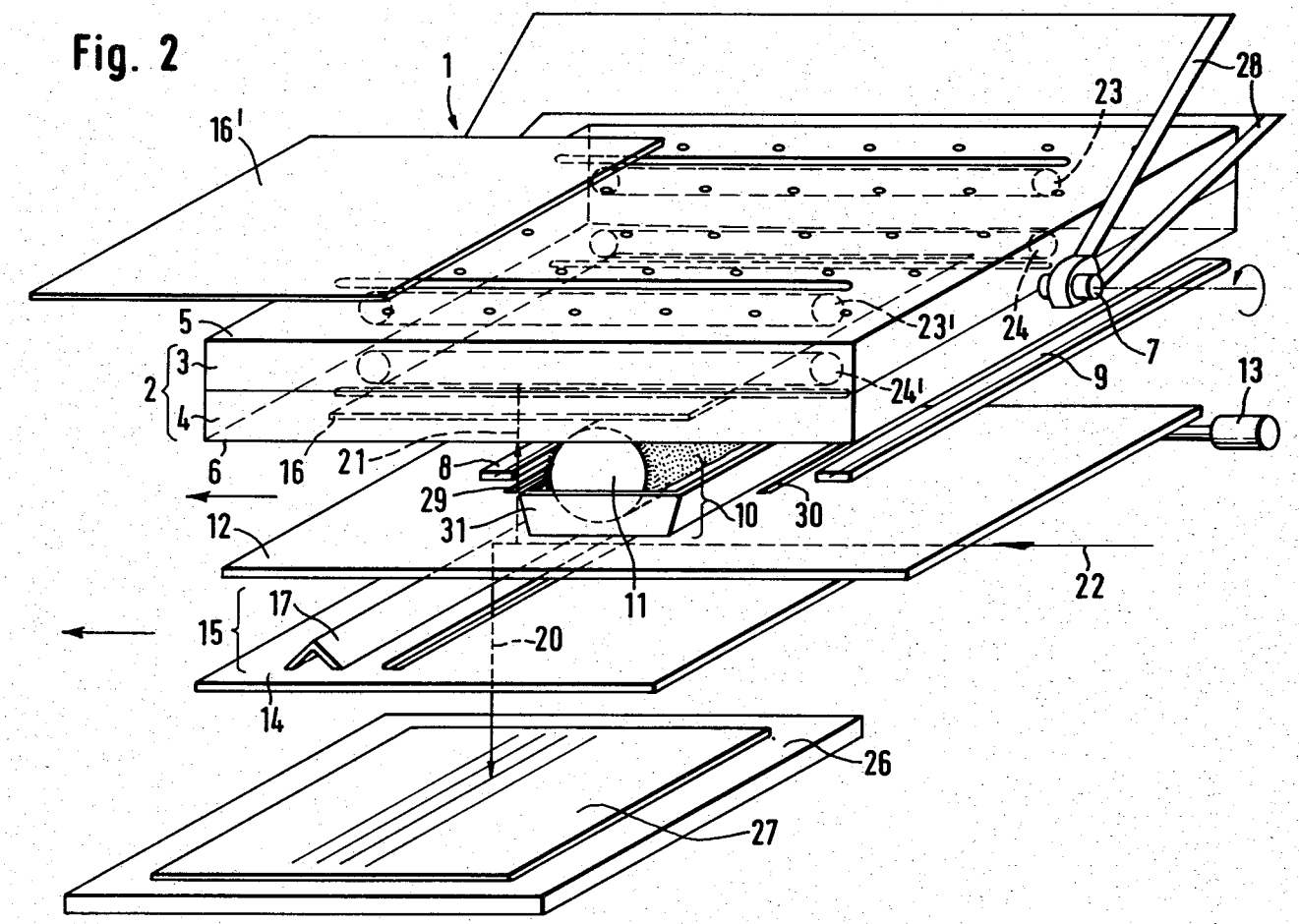
FIG. 2 is a diagrammatic representation of the processing station with the exposure table rotated through 180° during forward travel of the scanning table.

The processing station 1 shown in FIGS. 1 and 2 as an example of the invention comprises an exposure table 2 and a developing unit 10 which is arranged on a carriage 12 and includes a developer roll 11 with corona charging devices 8 and 9 positioned on either side of the developer roll. The carriage 12 which is displaceably mounted below the exposure table 2, is moved by a drive means such as a motor 13.

Underneath the carriage 12, a scanning table 14 is provided, carrying an optical scanning-exposure device 15 (only partly shown in the drawing). The optical scanning-exposure device comprises a roof mirror arrangement 17 as well as other conventional optical elements which have been omitted from the drawing for clarity. For example, the optical system may comprise two lasers emitting radiation of different wavelengths, beam spreaders, collimators deviating mirrors and a conventional acousto-optical modulator in the beam path of one of the lasers. The two laser beams are united to form a common beam 22 which impinges upon the dichroic mirrors 18 and 19 of the roof mirror arrangement 17. The mirror 18 of the roof mirror arrangement 17 reflects the recording beam 21 in the upward direction, while allowing the reading beam 20 to pass. Beam 20, in turn, is deflected downwardly by the mirror 19 and is guided through a slot 25 in the scanning table 14 onto an original 27 which lies on an original table 26.

The exposure table 2 comprises two superposed tables 3 and 4 which are arranged so that their suction plates 5 and 6 constitute the topside and the underside, respectively, of the exposure table 2 (FIG. 2). The exposure table 2 is adapted to be rotated through 180° about a pin 7. The pin 7 is connected to a two-legged bracket 28 which is attached to the housing or to the inner housing wall (not shown) of the processing unit. Each of the two suction tables 3 and 4 is provided with a conventional, internal, endlessly revolving drive means 23 and 23' and 24 and 24'. Suitable drive means include chain drives or belt drives which can be raised from the interior of each suction table to such an extent that a printing plate 16 or 16' lying on the suction table is lifted from the upper surface of the exposure table 2 and is transferred by the drive means to a further processing station, e.g. a fixing station, in the processing unit. Raising of the drive means is effected in each case after the reduced pressure in the upper suction table 3 or 4 has been released.

The two corona charging devices 8 and 9 are arranged symmetrically with respect to the developer roll 11. Underneath the developer roll 11, a supply bin or container 31 for the developer is mounted on the carriage 12. The printing plate 16 which is retained on the suction plate 6 on the underside of the exposure table 2 is developed as it contacts the top of developer roll 11. Any excess developer applied to the printing plate is not carried out of the processing unit by the plate, but falls back into the supply container 31.

Scanning table 14 and carriage 12 are driven independently of each other, but during each cycle they are displaced synchronously to ensure an exact sequence of charging, exposing and developing of the printing plate.

The carriage 12 is provided with two openings 29 and 30. During the forward or backward travel of the carriage 12, the recording beam 21 is directed through these openings, respectively, onto the printing plate 16 which is to be covered with written information. During the forward travel, the scanning table 14 is displaced at such a speed relative to the carriage 12 that the roof mirror arrangement 17 guides the recording beam 21 between the developer roll 11 and the rear corona charging device 8 in the direction of forward travel through the opening 29 in the carriage 12 and onto the printing plate 16 to be exposed, as shown in FIG. 2.

As the scanning table 14 travels backwards, the roof mirror arrangement 17 guides the recording beam 21 between the developer roll 11 and the front corona charging device 9 in the direction of forward travel through the opening 30 in the carriage 12 onto the printing plate 16' to be exposed as seen in FIG. 1. Upon rotation of the exposure table 2 from its initial position through 180° printing plate 16' assumes the position on the underside of the exposure table 2 previously occupied by printing plate 16 which by that time has been transported to a further location.

The operation of the processing station is explained briefly as follows:

In the initial position of the exposure table 2 shown in FIG. 1, a printing plate 16 rests on the upper surface of the exposure table 2. Reduced pressure is produced in the interior of the suction table, 4 and the printing plate 16 is drawn by suction to the suction table 4 through the holes in the suction plate 6. Then the exposure table 2 is rotated through 180° about the pin 7. The printing plate 16 is now on the underside of the exposure table 2 (FIG. 2). After this rotation through 180°, a fresh printing plate 16' is removed from a plate holder by means of a gripping unit (not shown) and is transported to the exposure table 2, where it is positioned on the suction plate 5 of the suction table 3 which is now on the upper side of the exposure table. After the rotation of the exposure table 2, the carriage 12 and the scanning table 14 are synchronously set in motion, in displaced position with respect to each other, so that the recording beam 21 will always pass through the opening 29 in the carriage 12 and cover the printing plate 16 with writing or other desired images while the reading beam 20 scans the original 27 through the slot 25 in the scanning table 14. The original 27 and the printing plate 16 are thus substantially simultaneously scanned and imaged, respectively.

When the forward travel commences (FIG. 2), the exposure cycle of the printing plate 16 begins. In the exposure cycle, the corona charging device 8 charges the printing plate 16, before the recording beam 21 controlled by the reading beam 20 transfers the information from the original 27 to the printing plate 16. Exposure of the printing plate 16 is immediately followed by overhead development with the aid of the developer roll 11.

After completion of exposure and development, scanning table 14 and carriage 12 are displaced a sufficient distance relative to the exposure table 2 so that the exposure table can be freely rotated back through 180°. The second printing plate 16' is thereby moved into the exposure position on the underside of the exposure table. The suction plate 5 of the suction table 3 is now on the underside of the exposure table 2. For backward travel of the carriage 12 and the scanning table 14, the two elements are displaced with respect to each other and synchronously driven in such a way that the recording beam 21 passes through the opening 30 between the developer roll 11 and the second corona device 9 and impinges on the printing plate 16' which is to be exposed (FIG. 1). Accordingly, printing plate 16' can be charged, exposed and developed, while the two elements travel backwards. During backward travel, the first printing plate 16 lying on the upper surface of the exposure table 2 is transported by the drive means 24 and 24' toward a further processing station, i.e. the fixing station (not shown). For this purpose, the reduced pressure in the upper suction table 4 is released and then the drive means 24 and 24' which, for example, comprise two mutually spaced, endlessly revolving chains or belts, is moved upwardly through slots out of the suction table 4 so that the printing plate 16 is lifted from the suction plate 6 and can be removed without difficulty from the exposure table 2 for further processing.

As soon as the backward travel is completed and the printing plate 16' is developed, the exposure table 2 is rotated again through 180°. The printing plate 16' is now on the upper surface of the exposure table and is lifted from suction plate 5 and transported toward the fixing station by the drive means 23 and 23' which corresponds in construction to the drive means 24 and 24'.

The developer roll 11 rotates in the respective developing cycle, i.e. forward or backward travel, counter to the direction of transport. A proximity switch (not shown) may be provided on each suction plate 5 and 6 to signal the gripping device to transport a fresh printing plate to the exposure table 2, as soon as the exposed printing plate is removed from the exposure table thereby actuating the proximity switch.

The foregoing embodiment has been described merely for purposes of illustration and is not intended to be limiting. Since modifications of the disclosed embodiment incorporating the spirit and substance of the invention may occur to persons skilled in the art, the scope of the invention is to be limited solely with respect to the appended claims and equivalents.

I claim:

1. A processing station for charging, exposing and developing printing masters, comprising an exposure table, at least one corona device, a developing unit and an optical scanning-exposure device; said exposure table being adapted to be rotated through 180° about a pin and comprising two superposed suction tables which are arranged in such a way that their suction plates form the topside and the underside of the exposure table.

2. A processing station according to claim 1, wherein said developing unit comprises a developer roll which is arranged together with two corona devices on a carriage below the exposure table; said carriage being horizontally displaceable forward and backward with the aid of a drive means.

3. A processing station according to claim 2, wherein the developer roll applies developer from the top of the roll to a printing plate which is held by the suction plate on the underside of the exposure table.

4. A processing station according to claim 2 or 3, wherein said two corona devices are arranged symmetrically with respect to the developer roll.

5. A processing station according to claim 2, wherein said scanning device comprises a scanning table carrying a roof mirror arrangement of dichoric mirrors which are selectively transparent to a reading beam and a recording beam of different wavelengths; said reading beam and recording beam being integrated to form a common beam.

6. A processing station according to claim 5, wherein said scanning table is adapted to be displaced synchronously with the developing unit and the corona devices.

7. A processing station according to claim 5, wherein the scanning table is displaced during forward travel in such a way that the roof mirror arrangement guides the recording beam between the developer roll and the rear corona device in the direction of forward travel onto a printing plate to be exposed.

8. A processing station according to claim 5, wherein, during backward travel of the scanning table, the roof mirror arrangment guides the recording beam between the developer roll and the front corona device in the direction of forward travel onto a printing plate to be exposed.

9. A processing station according to claim 1, wherein each of said two suction tables is provided with an internal, endlessly revolving drive means which can be raised to lift a printing plate lying on the suction table from the upper surface of the exposure table for transport to a further processing station.

10. A processing station according to claim 9, wherein said drive means comprise chain drives and the chain drive in the upper suction table is displaced upwardly out of the suction table after the reduced pressure in the upper suction table is released.

11. A processing station according to claim 2, 7 or 8, wherein said carriage is provided with two openings extending transversely to the direction of movement of said carriage.

12. A processing station according to claim 1 or 3, wherein said scanning device comprises a scanning table carrying a roof mirror arrangement of dichoric mirrors which are selectively transparent to a reading beam and a recording beam of different wavelengths; said reading beam and recording beam being integrated to form a common beam.

* * * * *